US007914421B2

(12) United States Patent
Weier et al.

(10) Patent No.: US 7,914,421 B2
(45) Date of Patent: Mar. 29, 2011

(54) TREADMILL DECK LOCKING MECHANISM

(75) Inventors: Keith M. Weier, Poway, CA (US); Douglas A. Crawford, Lafayette, CO (US); Kuo-Ti Huang, Chiayi County (TW)

(73) Assignee: Nautilus, Inc., Vancouver, WA (US)

( * ) Notice: Subject to any disclaimer, the term of this patent is extended or adjusted under 35 U.S.C. 154(b) by 0 days.

(21) Appl. No.: 12/816,196

(22) Filed: Jun. 15, 2010

(65) Prior Publication Data

US 2010/0248904 A1 Sep. 30, 2010

Related U.S. Application Data

(63) Continuation of application No. 11/205,470, filed on Aug. 16, 2005, now Pat. No. 7,736,280.

(60) Provisional application No. 60/602,349, filed on Aug. 17, 2004.

(51) Int. Cl.
*A63B 22/00* (2006.01)

(52) U.S. Cl. ..... 482/54; 482/51

(58) Field of Classification Search ..... 482/51, 482/54; 119/700; 434/247
See application file for complete search history.

(56) References Cited

U.S. PATENT DOCUMENTS

| | | | |
|---|---|---|---|
| 931,394 | A | 8/1909 | Day |
| 4,544,153 | A | 10/1985 | Babcock |
| 4,572,500 | A | 2/1986 | Weiss |
| 4,679,787 | A | 7/1987 | Guilbault |
| 4,757,987 | A | 7/1988 | Allemand |
| 4,817,939 | A | 4/1989 | Augspurger et al. |
| 4,844,449 | A | 7/1989 | Truslaske |
| 5,007,630 | A | 4/1991 | Real |
| 5,072,928 | A | 12/1991 | Stearns et al. |
| 5,302,162 | A | 4/1994 | Pasero |
| 5,336,146 | A | 8/1994 | Piaget et al. |
| 5,407,408 | A | 4/1995 | Wilkinson |
| 5,431,612 | A | 7/1995 | Holden |
| 5,476,431 | A | 12/1995 | Wilkinson et al. |
| 5,518,471 | A | 5/1996 | Hettinger et al. |
| 5,662,557 | A | 9/1997 | Watterson et al. |
| 5,669,857 | A | 9/1997 | Watterson et al. |
| 5,672,140 | A | 9/1997 | Watterson et al. |
| 5,674,156 | A | 10/1997 | Watterson et al. |
| 5,674,453 | A | 10/1997 | Watterson et al. |
| 5,676,624 | A | 10/1997 | Watterson et al. |
| 5,683,332 | A | 11/1997 | Watterson et al. |
| 5,704,879 | A | 1/1998 | Watterson et al. |

(Continued)

FOREIGN PATENT DOCUMENTS

TW 579875 Y 3/2004

OTHER PUBLICATIONS

Treadmill Owner's Manual by Formula 22100 Manual Treadmill, date unknown.

(Continued)

*Primary Examiner* — Glenn Richman
(74) *Attorney, Agent, or Firm* — Dorsey & Whitney LLP

(57) ABSTRACT

The present invention relates to a locking mechanism for use with exercise treadmills capable of being selectively configured in an operating configuration or a storage configuration. The locking mechanism may utilize various configurations of engagement devices and/or locking members to allow a user to selectively lock a treadmill frame in a fixed position relative to a base frame.

16 Claims, 13 Drawing Sheets

U.S. PATENT DOCUMENTS 5,718,657 A 2/1998 Dalebout et al.
D392,351 S 3/1998 Coody et al.
5,733,228 A 3/1998 Stevens
D393,297 S 4/1998 McBride et al.
5,746,682 A 5/1998 Hung
5,772,560 A 6/1998 Watterson et al.
5,830,113 A 11/1998 Coody et al.
5,839,993 A 11/1998 Fox
5,855,537 A 1/1999 Coody et al.
5,868,648 A 2/1999 Coody et al.
5,899,834 A 5/1999 Dalebout et al.
6,015,368 A * 1/2000 Clem et al. ..... 482/54
6,030,319 A * 2/2000 Wu ..... 482/51
6,059,695 A 5/2000 Hung
6,213,919 B1 4/2001 Wang et al.
6,261,209 B1 * 7/2001 Coody ..... 482/54
6,273,842 B1 8/2001 Wang et al.
6,325,745 B1 12/2001 Yu
6,350,218 B1 2/2002 Dalebout et al.
6,383,120 B1 * 5/2002 Lo ..... 482/54
6,387,016 B1 5/2002 Lo
6,461,275 B1 10/2002 Wang et al.
6,471,622 B1 10/2002 Hammer et al.
6,575,879 B1 6/2003 Harney
6,579,211 B2 6/2003 Wu
6,638,200 B2 10/2003 Chang
6,695,751 B1 2/2004 Hsu
6,723,027 B1 4/2004 Lo
6,746,374 B2 6/2004 Chang
6,746,376 B2 6/2004 Chang
6,758,791 B1 7/2004 Kuo
6,761,667 B1 7/2004 Cutler et al.
6,811,518 B2 11/2004 Lin
6,830,540 B2 * 12/2004 Watterson et al. ..... 482/54
6,855,095 B2 2/2005 Chang
6,926,644 B2 8/2005 Chen
6,974,404 B1 12/2005 Watterson et al.
6,979,283 B2 * 12/2005 Pan et al. ..... 482/54
7,004,887 B2 2/2006 Pan et al.
7,104,937 B2 9/2006 Arbuckle et al.
7,211,029 B2 5/2007 Kau
7,357,758 B2 4/2008 Polk, III et al.
7,455,626 B2 11/2008 Trevino et al.
7,544,153 B2 6/2009 Trevino et al.
2001/0049323 A1 12/2001 Fox
2005/0159273 A1 7/2005 Chen
2005/0164840 A1 7/2005 Chen
2006/0003869 A1 1/2006 Huang et al.

OTHER PUBLICATIONS

Taiwan Official Letter (Preliminary Examination Report) and Search Report and English translation thereof for corresponding Taiwan Patent Application No. 094128004 dated Apr. 30, 2008 (8 pages).

* cited by examiner

TREADMILL DECK LOCKING MECHANISM

CROSS-REFERENCE TO RELATED APPLICATIONS

This application is a continuation of U.S. patent application Ser. No. 11/205,470, filed on Aug. 16, 2005 and entitled "Treadmill Deck Locking Mechanism", now U.S. Pat. No. 7,736,280, which claims the benefit under 35 U.S.C. §119(e) to U.S. Provisional Patent Application No. 60/602,349, filed on Aug. 17, 2004 and entitled "Treadmill Deck Locking Mechanism", which are hereby incorporated in their entireties by reference as though fully disclosed herein.

FIELD OF THE INVENTION

The present invention relates to treadmills, and more particularly, to a locking device for a treadmill having a treadmill deck pivotally connected with a base frame and positionable between an operating position and a storage position.

BACKGROUND OF THE INVENTION

Many currently available exercise treadmills include a treadmill deck supported on a treadmill frame, which in turn, is coupled with a base frame. Some of these exercise treadmills cover a substantial amount of floor space. Therefore, some treadmills provide treadmill decks that are positionable between a downward operating configuration and a generally upright storage configuration to reduce the amount of floor space taken up by the treadmill when not in use. However, adjustment or repositioning of the treadmill deck between the two configurations can be cumbersome. Therefore, there is a need in the art for a mechanism that provides for easy repositioning of a treadmill base.

BRIEF SUMMARY OF THE INVENTION

Aspects of the present invention relate to locking mechanisms for treadmills configurable between an operating configuration and a storage configuration. As discussed in more detail below, some treadmills include a treadmill frame pivotally coupled with a base frame. As such, embodiments of the present invention involve a locking mechanism for selectively locking the treadmill frame in a fixed position relative to the base frame. Other aspects of the present invention relate to a lift assist mechanism operably coupled with the treadmill frame and the base frame and adapted to resist pivotal movement of the treadmill frame in a downward direction. It is to be appreciated that embodiments of the present invention described and depicted herein can be configured to work with various types of exercise treadmills and should not be construed to be limited to use with only the treadmills disclosed herein.

In one aspect of the present invention, a treadmill configurable between an operating configuration and a storage configuration includes: a base frame and a treadmill frame pivotally connected with the base frame. The treadmill frame supports a deck, a front roller, and a rear roller, and has a tread belt positioned about the first and second rollers and passing over the deck. The treadmill also includes a locking mechanism operable to selectively lock the treadmill frame in a fixed position relative to the base frame. The locking mechanism is operable to selectively lock the treadmill frame in a fixed position relative to the base frame. In a further embodiment, the locking mechanism is operable to selectively lock the treadmill frame in a storage position and an operating position. In another aspect of the invention, the locking mechanism has a locking member connected with the treadmill frame and adapted to selectively engage at least one aperture on the base frame. In alternative embodiments, the locking member is spring loaded and/or a pop-pin. The locking mechanism, according to another aspect of the invention, has a knob and a cable connected with the locking member. Alternatively, the locking mechanism has a locking handle and a cable connected with the locking member. The locking mechanism can also have a locking member connected with the treadmill frame that is adapted to selectively engage a first aperture on the base frame to lock the treadmill base in an operating position and a second aperture on the base frame to lock the treadmill base in a storage position. The first aperture, in one embodiment, is elongated. In an additional embodiment, the locking mechanism has a locking member connected with the base frame and adapted to selectively engage at least one aperture on the treadmill frame. In a further aspect of the invention, the treadmill has a lift assistance mechanism operably coupled to the treadmill frame and the base frame. The lift assistance mechanism has, in one embodiment, at least one lift cylinder.

In another form of the present invention, a treadmill configurable between an operating configuration and a storage configuration includes a base frame and a treadmill frame. The base frame defines a first bracket defining a first aperture corresponding with the operating configuration and a second aperture corresponding with the storage configuration. The treadmill frame is pivotally connected with the base frame and supports a deck, at least one roller, and a tread belt passing over the deck. The treadmill frame also includes at least one frame rail including a second bracket supporting a pin movable between a first engaged position and a second disengaged position.

According to one aspect of the invention, the treadmill also has an actuator mechanism associated with the treadmill frame. The actuator mechanism is configured to actuate the pin to move between the first engaged position and the second disengaged position. The actuator mechanism has, in one embodiment, a rotatable knob and a cable operably coupled to the rotatable knob and the pin. Alternatively, the actuator mechanism has a handle and a cable operably coupled to the handle and the pin. In one embodiment, the treadmill also has a pivot member configured to pivotally connect the treadmill frame with the base frame. The pivot member can pivotally connect the first bracket and the second bracket. The treadmill in one aspect of the invention also has a lift assistance mechanism operably coupled to the base frame and the treadmill frame. The lift assistance mechanism is configured to urge the treadmill frame upward when the treadmill frame is moved between the operating configuration and the storage configuration.

In yet another form of the present invention, a treadmill includes a base frame, a treadmill frame, a locking mechanism, and an actuator mechanism. The treadmill frame is pivotally coupled to the base frame. The locking mechanism has a first bracket connected to the treadmill frame, a second bracket connected to the base frame, and a pivot member operably coupled with the first bracket and the second bracket. The first bracket has an engagement member. The second bracket is configured to engage with a portion of the engagement member. According to one embodiment, the pivot member allows the first bracket and the second bracket to be rotatable relative to each other. The actuator mechanism has an actuable member and a cable. The actuable member can be, in one aspect of the invention, a rotatable knob or a handle. The cable is operably coupled with the actuable member and the engagement member, and allows the engagement member to be movable between an engaged position and a disengaged position.

In still another form of the present invention, a treadmill includes: a base frame; a treadmill frame; and a locking mechanism. The locking mechanism includes an engagement member movable between an engaged position and a disengage position and an actuation mechanism including a handle pivotable about an axis. Pivoting the handle about the axis causes the engagement member to move between the engaged and disengaged positions.

In still another form of the present invention, a method for selectively positioning a treadmill frame relative to a base frame of a treadmill includes pivoting a handle member about a pivot axis to cause an engagement member to move between an engaged position and a disengaged position.

In still another embodiment of the present invention, a treadmill configurable between an operating configuration and a storage configuration includes: a base frame and a treadmill frame pivotally connected with the base frame. The treadmill frame supports a deck and at least one roller, and has a tread belt positioned about the at least one roller and passing over the deck. The treadmill frame is adapted to pivot between a downward operating position and upward storage position. The treadmill also includes a lift assistance mechanism operably coupled with the base frame and the treadmill frame.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive. The features, utilities, and advantages of various embodiments of the invention will be apparent from the following more particular description of embodiments of the invention as illustrated in the accompanying drawings and defined in the appended claims.

DETAILED DESCRIPTION OF THE INVENTION

Aspects of the present invention provide a locking mechanism for use with exercise treadmills having a foldable treadmill frame. As discussed in more detail below, some treadmills are configured with the treadmill frame pivotally connected with a base frame to provide a user the ability to selectively place the treadmill in an operating configuration or a storage configuration. More particularly, the user can pivot the treadmill frame upward relative to the base frame to a generally upright position to place to the treadmill in the storage configuration. The user can also pivot the treadmill frame downward to place the treadmill in the operating configuration. As such, embodiments of the present invention involve a locking mechanism for selectively locking the treadmill frame in a fixed position relative to the base frame. In one embodiment, the treadmill frame may be locked in the operating configuration, the storage configuration, or some position therebetween. In another embodiment, the locking mechanism is configured to lock the treadmill in both the operating configuration and the storage position, while other embodiments are configured to lock the treadmill only in the storage configuration or only the operating configuration. Still other embodiments allow some relative movement between the treadmill frame and the base frame when the treadmill is in a locked state. It is to be appreciated that embodiments of the locking mechanism described and depicted herein can be configured to work with various types of exercise treadmills and should not be construed to be limited to use with only the treadmills disclosed herein.

Figure 1:
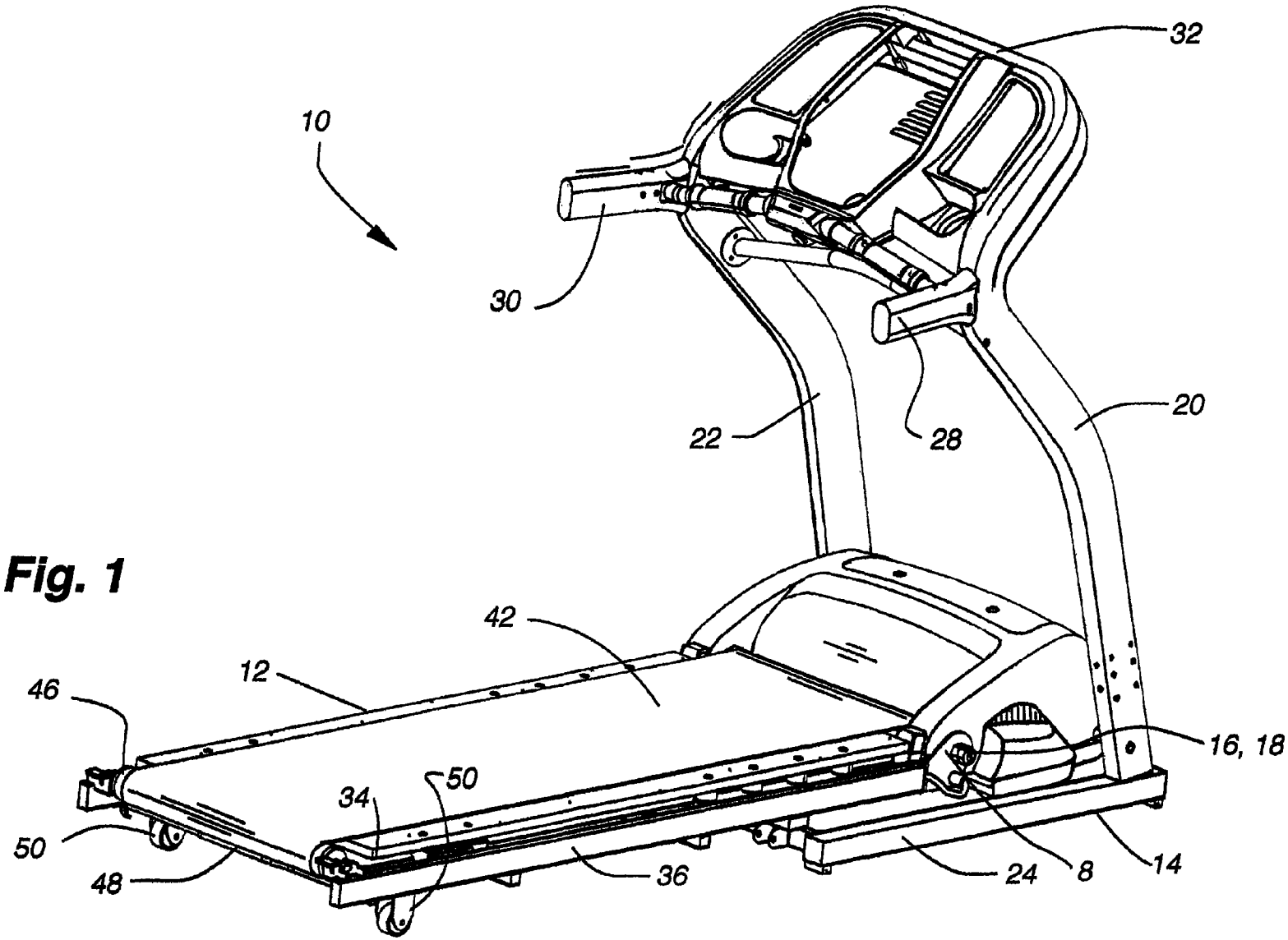
FIG. 1 is a right side isometric view of a treadmill in a operating configuration, according to one embodiment of the present invention.
Figure 2:
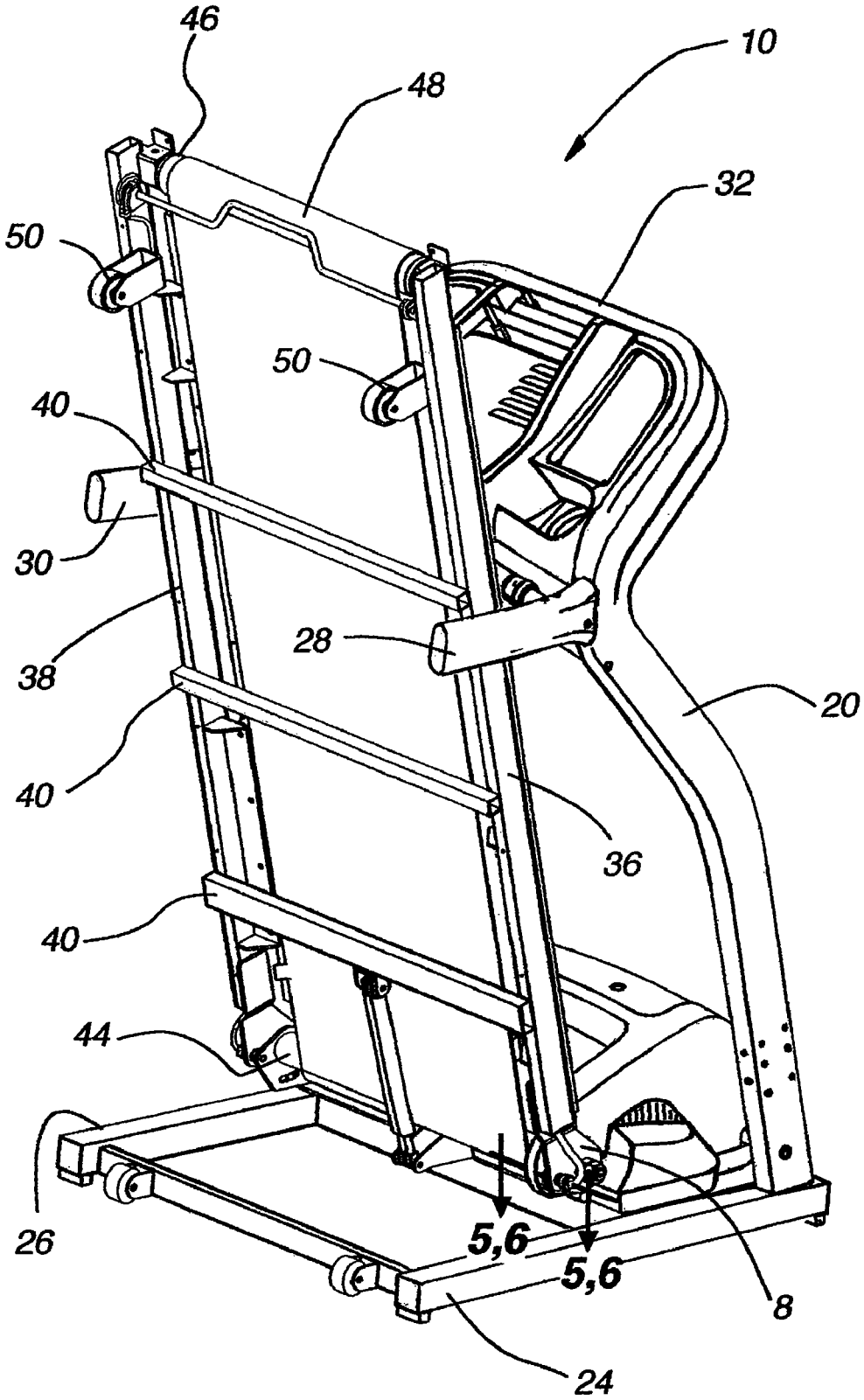
FIG. 2 is a right side isometric view of a treadmill in a storage configuration, according to one embodiment of the present invention.

FIGS. 1 and 2 show one example of a treadmill 10 with a locking mechanism adapted to selectively lock the treadmill in an operating configuration and a storage configuration. For example, FIG. 1 shows the treadmill 10 locked in the operating configuration, and FIG. 2 shows the treadmill 10 locked in the storage configuration. As shown in FIGS. 1 and 2, the exercise treadmill 10 includes a treadmill frame 12 pivotally connected with a base frame 14 at a pivotal connection 16, which also defines a pivot axis 18. An exemplary right locking mechanism 8 comprises a portion of, or is associated or integral with, the pivotal connection 16 and pivot axis 18. The base frame 14 includes a right upright member 20 and a left upright member 22 extending upwardly from a right base member 24 and a left base member 26, respectively. To provide a user with upper body support while using the treadmill 10, right and left handrails 28, 30 are connected with and extend rearwardly from the right and left upright members 20, 22, respectively. A display console 32 can also be supported between the right and left upright members 20, 22.

The treadmill frame 12 of FIGS. 1 and 2 supports a treadmill deck 34 and includes a right frame rail 36 and a left frame rail 38, both extending rearwardly from the pivotal connection 16 between the base frame 14 and the treadmill frame 12. The treadmill frame 12 can also include a plurality of cross members 40 extending between the right and left frame rails 36, 38 to provide additional mechanical support for the deck 34. A walking or running surface on the treadmill 10 is provided by a tread belt 42 adapted to move over the treadmill deck 34 between a front roller 44 and a rear roller 46, both of which are rotatably supported between the right and left frame rails 36, 38. It is to be appreciated that a locking mechanism of the present invention can function with various types of treadmills and should not be construed to be limited to function with only the treadmill shown in FIGS. 1 and 2, which is merely exemplary. According to one embodiment, the locking mechanisms of the present invention can generally be operable with any treadmill with a positionable treadmill base.

As discussed generally above, the treadmill 10 is shown in FIG. 1 in the operating configuration with the treadmill frame 12 extending rearwardly from the pivotal connection 16 in a generally horizontal position. While in the operating configuration, a rear portion 48 of the treadmill frame 12 is supported by wheels 50 in contact with the ground or floor. The treadmill 10 is placed in the storage position as shown in FIG. 2 by lifting the rear portion 48 of the treadmill frame 12 upward, causing the treadmill frame 12 to pivot around the pivotal connection 16 until the treadmill frame 12 extends upwardly from the pivotal connection 16 and the base frame 14 in a generally vertical position. The locking mechanism 8 of the present embodiment can be utilized to allow a user to selectively lock the treadmill frame 12 in the operating position of FIG. 1 and/or the upright storage position of FIG. 2.

Figure 3:
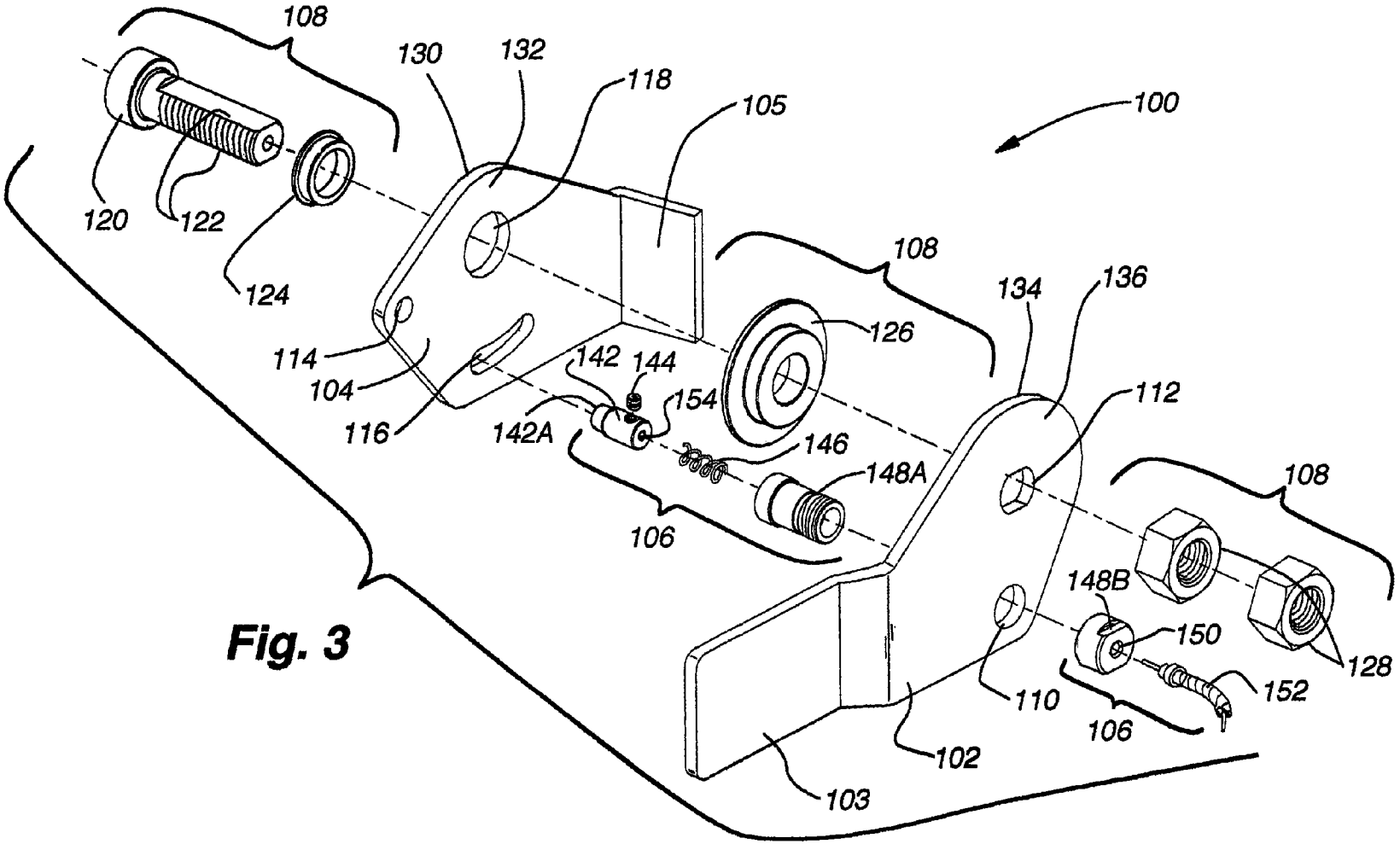
FIG. 3 is an exploded right side isometric view of a locking mechanism, according to one embodiment of the present invention.
Figure 4:
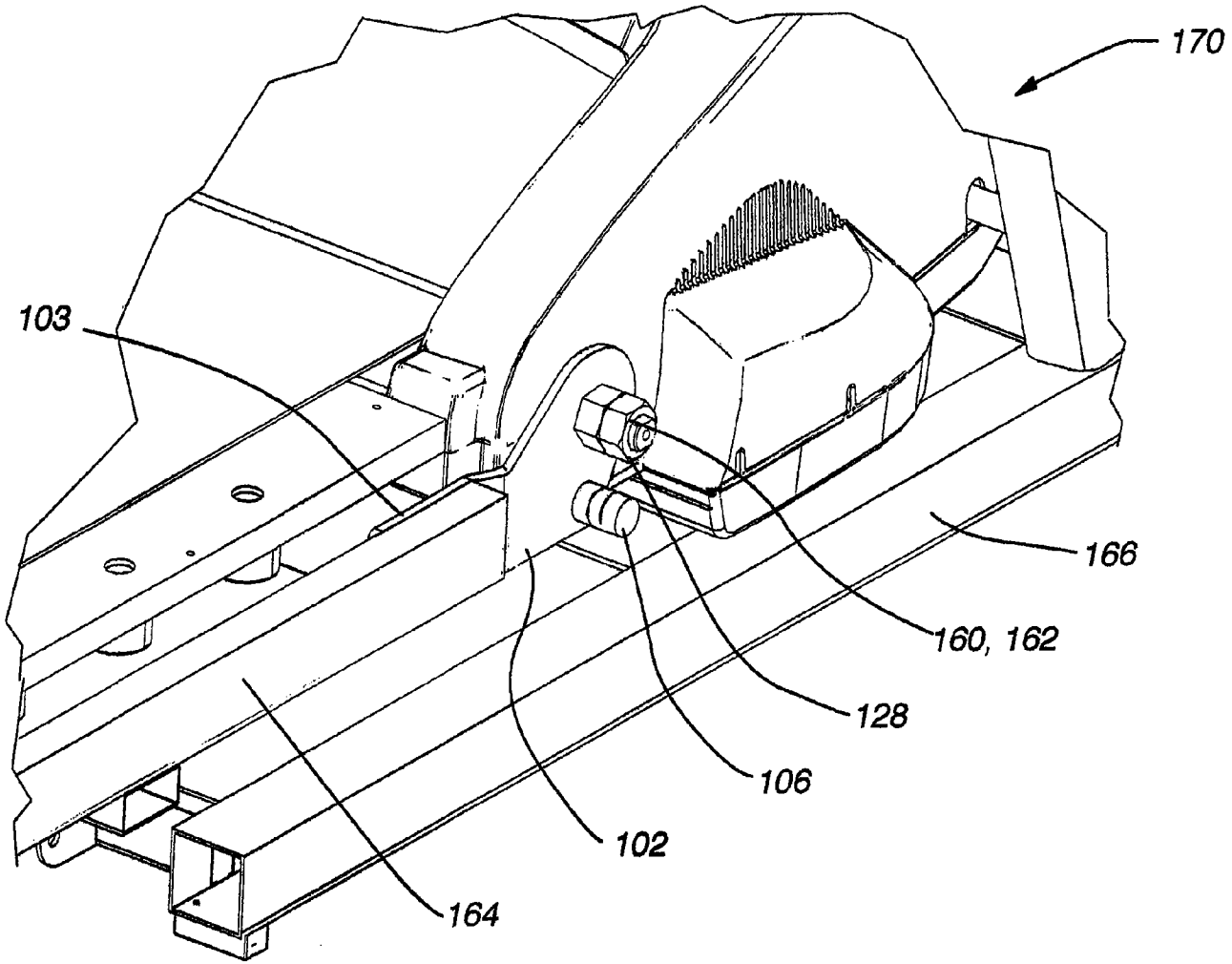
FIG. 4 is a right side isometric view of a treadmill with a locking mechanism, according to one embodiment of the present invention.

FIGS. 3 and 4 depict a locking mechanism 100, according to one embodiment of the present invention. The locking mechanism 100 has a first bracket 102, a second bracket 104, an engagement member 106, and a pivot member 108. According to one embodiment, the first bracket 102 and second bracket 104 are rotatable in relation to one another at the pivot member 108, while the engagement member 106 allows the two brackets 102, 104 to be lockable in specific positions in relation to one another. The first bracket 102 defines an engagement member aperture 110 and a pivot member aperture 112. The engagement member aperture 110 is configured to receive the engagement member 106, which is a pop-pin assembly 106 in FIG. 3. The pivot member aperture 112 is configured to receive the pivot member 108. The second bracket 104 defines a first engagement member receiving aperture 114, a second engagement member receiving aperture 116, and a pivot member aperture 118. The first and second engagement member receiving apertures 114, 116 are configured to receive the engagement member 106.

The pivot member 108 rotatably or pivotably connects the first bracket 102 and the second bracket 104. The pivot member 108, in accordance with one aspect of the present invention, has a threaded bolt 120, a first washer 124, a second washer 126, and two nuts 128. The threaded bolt, according to one embodiment, has two flat surfaces 122 along the threaded portion of the bolt 120. In use, the bolt 120 is disposed within the pivot member aperture 118 of the second bracket 104 and the pivot member aperture 112 of the first bracket 102 as shown in FIG. 3. The first washer 124 is positioned such that the bolt 120 is disposed therethrough and the washer 124 is further positioned on the first side 130 of the second bracket 104. The second washer 126 is positioned such that the bolt 120 is disposed therethrough and the washer 126 is positioned between the first bracket 102 and the second bracket 104. The two nuts 128 are configured to be threadably engaged with the bolt 120 and the nuts 128 are positioned on the second side 136 of the first bracket 102. Alternatively, the pivot member 108 can be any known component or device capable of allowing the two brackets 102, 104 to be rotatable relative to each other.

Figure 5:
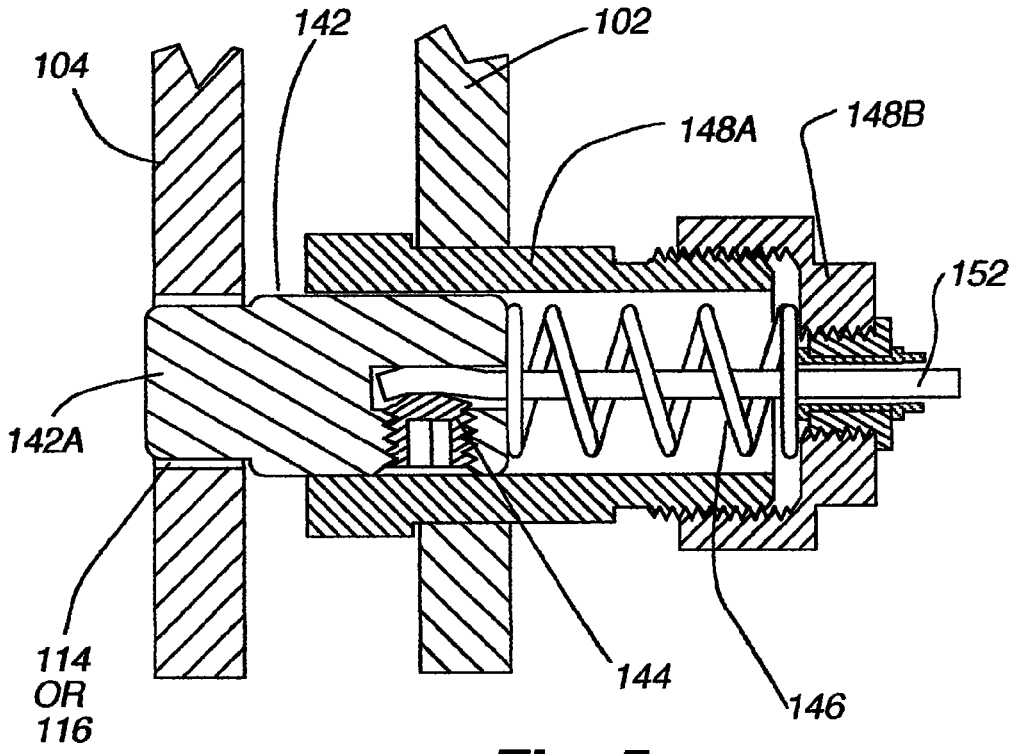
FIG. 5 is a cross-sectional view of the treadmill depicted in FIG. 2, taken along line 5-5.
Figure 6:
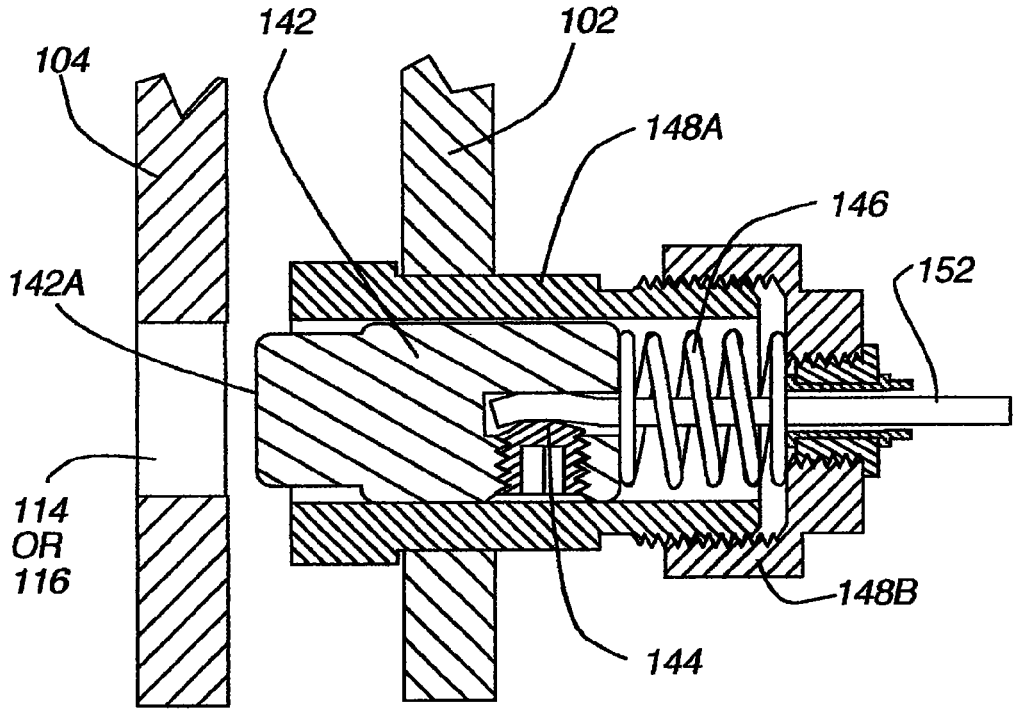
FIG. 6 is a cross-sectional view of the treadmill depicted in FIG. 2, taken along line 6-6.

The engagement member 106 according to one embodiment is a pop-pin assembly 106 as depicted in FIGS. 3, 5, and 6. The assembly 106 has a pin member 142 with a cable retention member 144. The pin member 142 is disposed within a pin housing 148A, 148B. The housing 148A, 148B comprises a threaded housing cylinder 148A and a threadable cap 148B configured to be capable of being threaded onto the cylinder 148A. The pin member 142 is configured to be received within the housing 148A, 148B. According to one embodiment, a spring 146 is disposed between the housing cap 148B and the pin member 142 such that the spring is configured to urge the pin member 142 away from the housing cap 148B and toward the second bracket 104. In one aspect of the invention, a cable 152 is configured to be insertable through an aperture 150 in the housing cap 148B and further into an aperture 154 in the pin member 142, where the cable 152 can be retained or removably attached to the pin member by threading the cable retention member 144 into the pin member 142 such that the cable 152 is clamped into place between the cable retention member 144 and an inner wall of the pin member 142. Alternatively, the cable 152 can be attached to the pin member 142 by any known method or device. The pin member 142, the spring 146, and the housing cylinder 148A, according to one embodiment, are positioned on the first side 134 of the first bracket 102, while the cap 148B is positioned on the second side 136 of the first bracket 102. Alternatively, it is to be understood that the engagement member 106 can be any known mechanism for locking the two brackets 102, 104 into various predetermined positions in relation to one another.

As shown in FIG. 4, the locking mechanism 100 in one aspect of the invention is configured to be associated with a right end portion of a pivotal connection 160 residing on the right hand side of a treadmill 170. The first bracket 102 is connectable at a connection portion 103 with a treadmill frame 164 of a treadmill 170 and the second bracket 104 (not shown in FIG. 4) is connectable at a foot portion 105 with a base frame 166. Alternatively, the first and second brackets 102, 104 are connectable at any portions of the brackets 102, 104 to any portion of the treadmill 170 so as to operate as a locking mechanism. According to one embodiment, the first bracket 102 is attached to the treadmill frame 164 such that the position of the first bracket 102 is fixed in relation to the treadmill frame 164, and the second bracket 104 is attached to the base frame 166 such that the position of the second bracket 104 is fixed in relation to the base frame 166. In such an embodiment, as the first bracket 102 rotates at the pivot member 108 in relation to the second bracket 104, the treadmill frame 164 can be repositioned in relation to the base frame 166, including being repositioned between operating and storage configurations.

In operation, according to one embodiment, the spring 146 as shown in FIG. 3 is configured to apply a biasing force between the cap 148B and the pin 142, thereby urging an end portion 142A of the pin member 142 to extend from the pin housing 148A, 148B a predetermined distance. By extending from the pin housing 148A, 148B, the end portion 142A of the pin 142 extends into either of the first engagement member receiving aperture 114 or the second engagement member receiving aperture 116 when either aperture 114, 116 is aligned with the pin assembly 106. The extension of the pin 142 into either of the apertures 114, 116 locks the first bracket 102 into a particular position in relation to the second bracket 104, thereby locking the treadmill frame 164 into a particular position relative to the base frame 166. According to one embodiment, when the engagement member 106 is received within the first engagement member aperture 114, the treadmill 170 is in the storage configuration and when the member 106 is received within the second aperture 116, the treadmill 170 is in the operating configuration.

FIG. 5 depicts the pin member 142 according to one embodiment in which it is extended into one of the apertures 114 or 116, while FIG. 6 depicts the pin member 142 according to another embodiment in which the pin member 142 is in its non-extended position (the pin member 142 is not extended out of the pin housing 148A, 148B). According to one embodiment, the pin member 142 is retained in or pulled into the non-extended position by the cable 152, which is configured to be pullable or movable in the direction opposite that urged by the spring 146 such that the force of the spring 146 can be overcome by the cable 152 pulling on the pin member 142. Alternatively, the engagement member 106 can comprise any components or configuration capable of urging the pin member 142 between its extended and non-extended positions.

Figure 7:
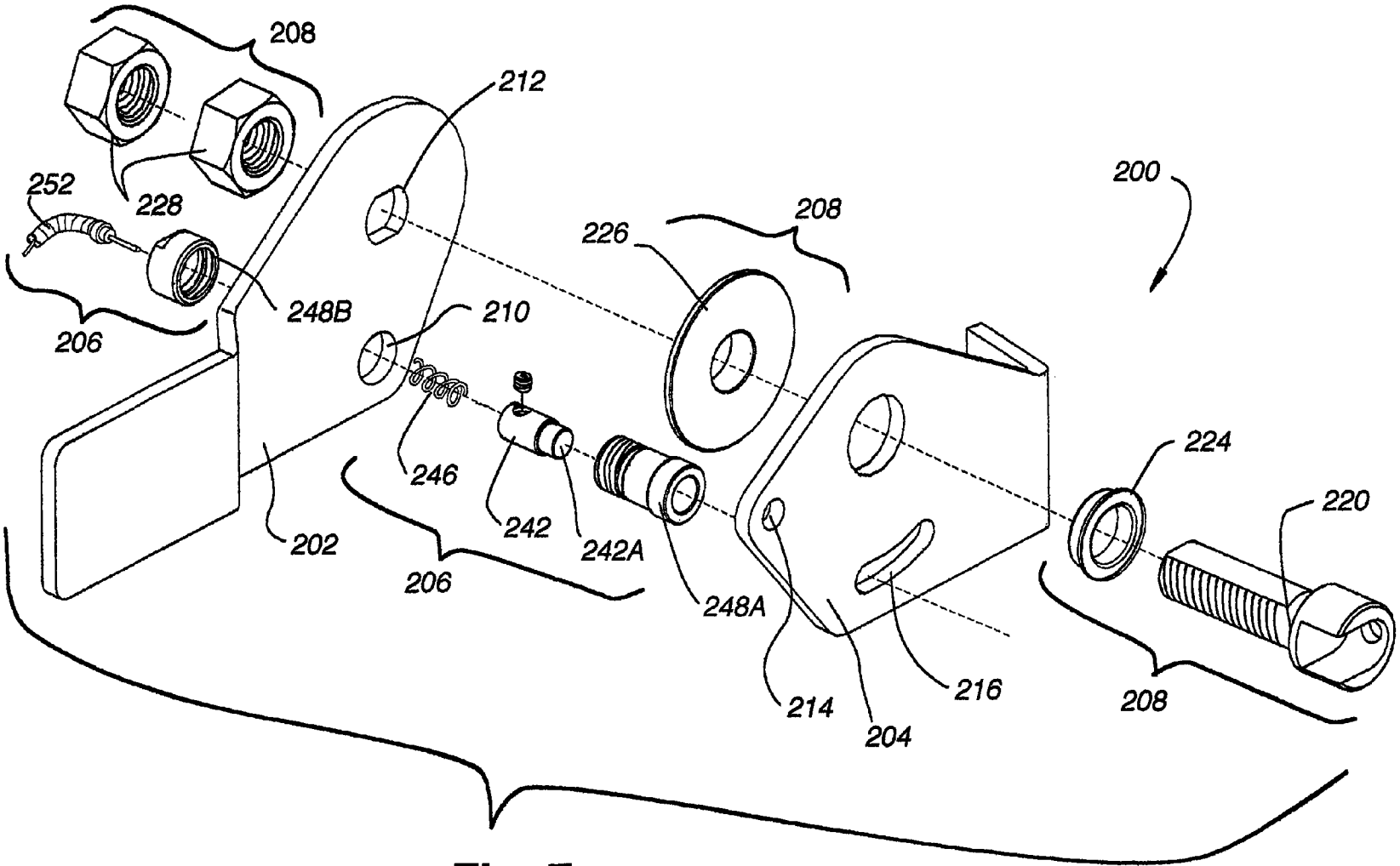
FIG. 7 is an exploded right side isometric view of a locking mechanism, according to one embodiment of the present invention.

While the locking mechanism 100 depicted in FIGS. 3 and 4 is, associated with the right end of the pivotal connection 160, FIG. 7 depicts a locking mechanism 200 for use on a left end portion of a pivotal connection, according to one embodiment. The locking mechanism 200 has a first bracket 202, a second bracket 204, an engagement member 206, and a pivot member 208. In one aspect of the invention, the engagement member 206 is a pop-pin assembly 206. Alternatively, the engagement member 206 can comprise any components or configuration capable of urging the pin member 242 between its extended and non-extended positions. The first bracket 202 defines an engagement member aperture 210 and a pivot member aperture 212. The engagement member aperture 210 is configured to receive the engagement member 206 and the pivot member aperture 212 is configured to receive the pivot member 208. The second bracket 204 defines a first engagement member receiving aperture 214, a second engagement member receiving aperture 216, and a pivot member aperture 218. The first and second engagement member receiving apertures 214, 216 are configured to receive the engagement member 206.

The pivot member 208 in FIG. 7 rotatably or pivotably connects the first bracket 202 and the second bracket 204. The pivot member 208, in accordance with one aspect of the present invention, has a threaded bolt 220, a first washer 224, a second washer 226, and two nuts 228. Alternatively, the pivot member 208 can be any known component or device capable of allowing the two brackets 202, 204 to be rotatable relative to each other. The pop-pin assembly 206 has a pin member 242 with a cable retention member 244. The pin member 242 is disposed within a pin housing 248A, 248B, which comprises a threaded housing cylinder 248A and a threadable cap 248B configured to be capable of being threaded onto the cylinder 248A. The pin member 242 is configured to be received within the housing 248A, 248B. According to one embodiment, a spring 246 is disposed between the housing cap 248B and the pin member 242. In one aspect of the invention, a cable 252 is configured to be insertable through an aperture (not shown) in the housing cap 248B and attached to the pin member 242. The pin member 242, the spring 246, and the housing cylinder 248A, according to one embodiment, are positioned on one side of the first bracket 202, while the cap 248B is positioned on the other side of the bracket 202.

It is to be appreciated that certain embodiments of the locking mechanism of the present invention need not include first and second brackets. For example, the pin housing could be connected directly with the treadmill frame and the base frame could include the first and second apertures. It is also to be appreciated that in certain alternative embodiments, treadmills of the present invention can have more than one locking mechanism located near or on either or both left and right end portions of a pivotal connection.

Figure 8:
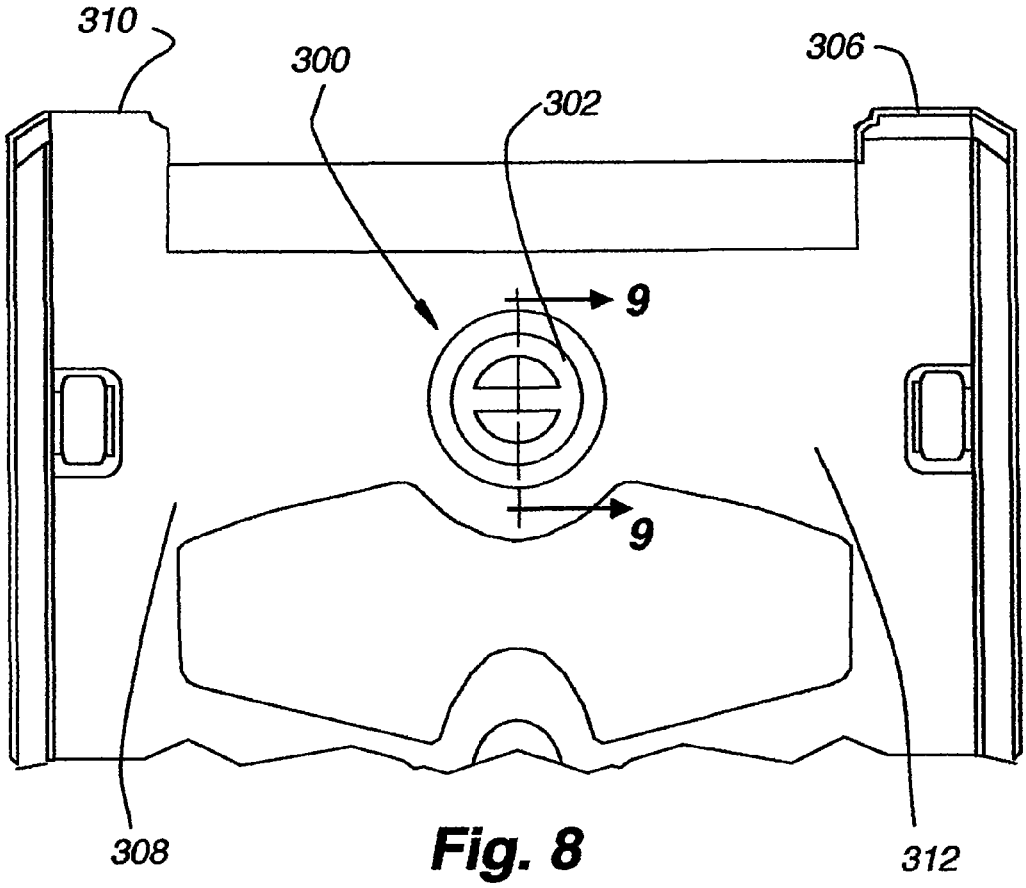
FIG. 8 is a bottom view of a treadmill base with an actuator mechanism, according to one embodiment of the present invention.

In one aspect of the invention, the cable attached to the pin member can be caused to urge or retain the pin member in a non-extended position by an actuator mechanism that is actuated by a user. FIGS. 8, 9, 10, and 11 depict an actuator mechanism 300, according to one embodiment of the present invention. The actuator mechanism 300 allows a user to selectively "unlock" the locking mechanism and reposition the treadmill frame 306 in relation to a base frame. As shown in FIG. 8, the actuator mechanism 300 is located on a bottom side 308 of the rear portion 310 of the treadmill frame 306. More specifically, the actuator mechanism 300 is connected or integral with a cover or "shrouding" 312 located on the bottom side 308 of the frame 206. The actuator mechanism 300 includes a turn knob 302 and a cable 304 connected at one end to the turn knob 302 and at the other end to a pin member in a pin housing (not shown) similar to the pin member described above.

Figure 9:
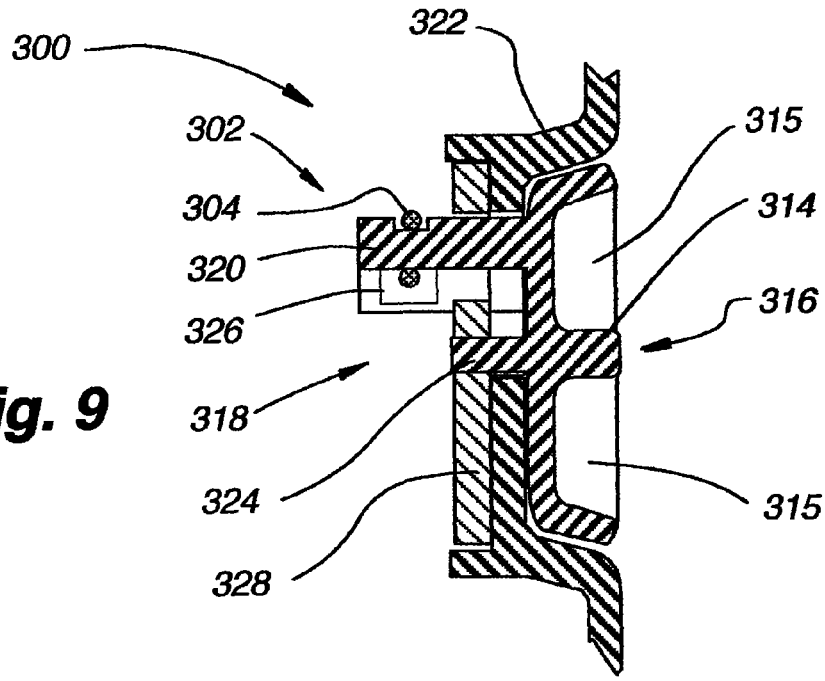
FIG. 9 is a cross-sectional view of the actuator mechanism depicted in FIG. 8, taken along line 9-9.
Figure 11:
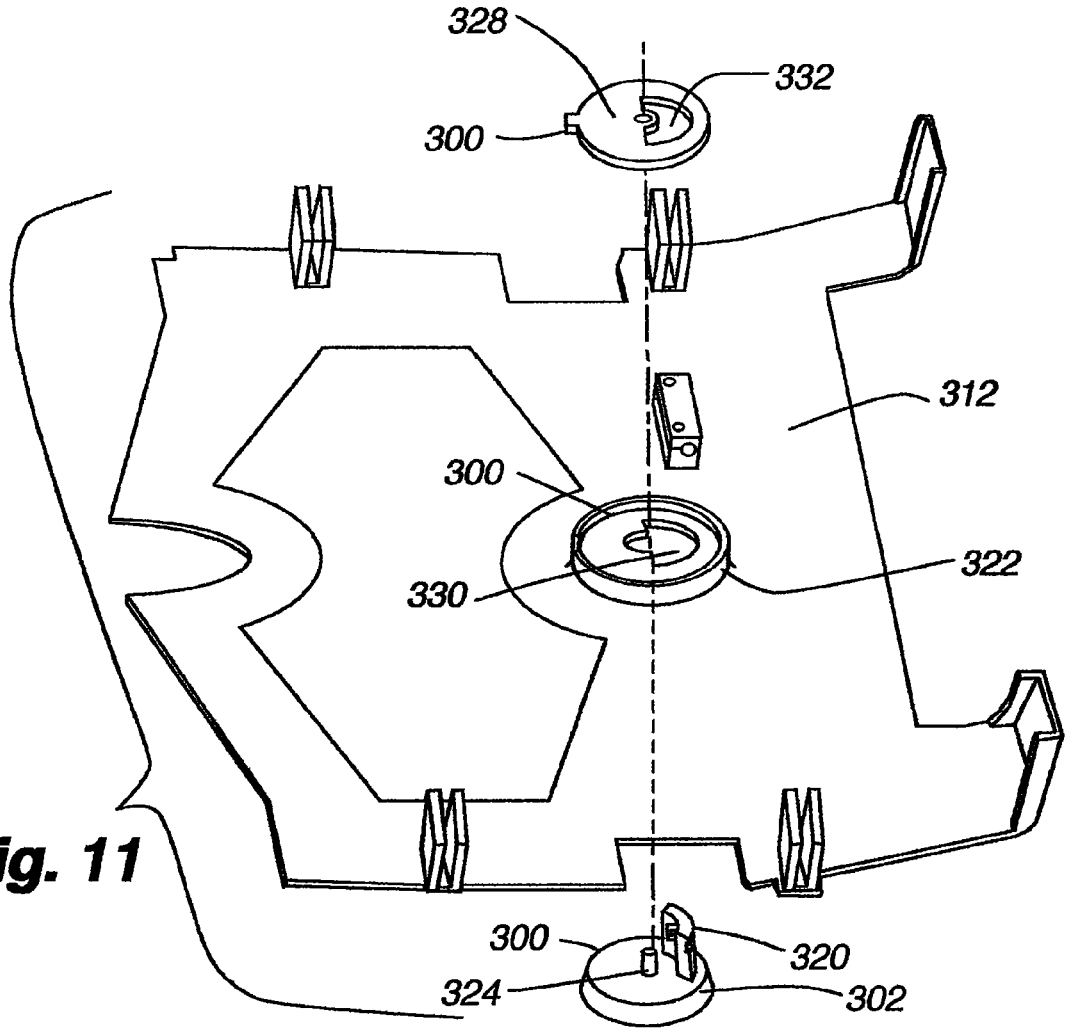
FIG. 11 is an exploded isometric view of an actuator mechanism, according to one embodiment of the present invention.

The actuator mechanism 300 is shown in further detail in FIG. 9, which depicts a cross-sectional view of the actuator mechanism 300 depicted in FIG. 8 taken along line 9-9, and FIG. 11, which provides an exploded view of the components of the mechanism 300 and the shrouding 312. The rotatable knob 302 of the mechanism 300 has a gripping portion 314, which is a raised portion 314 defined by two recessed portions 315 on the bottom side 316 on the knob 302. The knob 302 also has a projection 320 on the upper side 318 of the knob 302 that is connectable to the cable 304. In addition, the knob 302 has a knob axle 324 and is rotatably seated within a knob receiving portion 322 such that the knob 302 can rotate in relation to the knob receiving portion 322 around the axle 324. A knob connector 328 is positioned on the upper side of the knob receiving portion 322 and is connected with the knob axle 324, thereby retaining the knob 302 within the receiving portion 322. The knob 302 is positioned such that the upper side 318 of the turn knob 302 is adjacent to the bottom side of the shrouding 312, thereby allowing the projection 320 and axle 324 to extend upwardly through a semicircular knob aperture 330 in the knob receiving portion 322, which is attached to the shrouding 312. The knob connector 328 has an equivalent semicircular knob aperture 332. The semicircular apertures 330, 332 limit the radial travel of the turn knob 302. That is, the knob 302 can be rotated until the projection 320 comes into contact with the edges of the apertures 330, 332.

Figure 10:
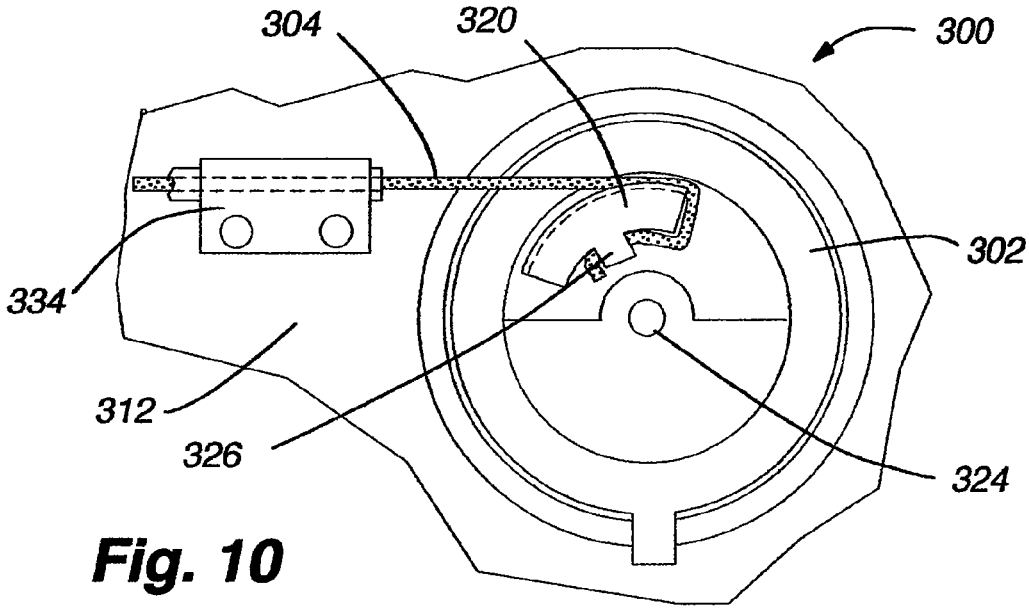
FIG. 10 is a top view of an actuator mechanism, according to one embodiment of the present invention.

FIG. 10 depicts an upper view of the knob 302 attached to the top portion of the shrouding 312. The projection 320, according to one embodiment, is an arcuate member 320 to which the cable 304 is attached. In this particular embodiment, the cable 304 is partially wrapped around the member 320 and attached at a cable bracket 326 by being inserted therethrough. From the projection 320, the cable 304 extends outwardly toward the right side of the treadmill frame 306 as shown in FIG. 10. According to one embodiment, the cable is disposed within a cable guide 334 positioned between the knob 302 and the right side of the treadmill frame 306. At the right side of the treadmill frame 306, the cable 304 is routed forwardly along the treadmill frame 306 toward the pivotal connection with the base frame (not shown). According to one embodiment, the change in direction in the cable 304 at the right side of the treadmill frame 306 is accomplished with a pulley (not shown). Alternatively, the re-routing of the cable 304 can be caused by any known mechanism for changing the direction of a cable or similar component. At or near the pivotal connection (not shown), the cable 304 is re-routed along the pivotal connection toward the first bracket (not shown). At the first bracket, the cable is disposed through a pin housing and attached to a pin in a configuration that, according to one embodiment, is similar to the configuration depicted in FIG. 3. Alternatively, the actuation mechanism 300 can be any known component capable of providing a pulling force on a cable connected to a locking mechanism.

In use, a user can rotate the turn knob 302 by grasping the gripping portion 314 with her fingers and applying a twisting force thereto. More particularly, when a user twists the turn knob 302, the knob 302 pulls the cable 304 attached thereto, and the cable 304 in turn operates to "unlock" a locking mechanism of the present invention. The unlocking of the locking mechanism can be accomplished in the following manner, according to one aspect of the present invention. The cable 304, according to one exemplary embodiment in which the cable 304 is coupled to an embodiment of the locking assembly 100 as depicted in FIG. 3, is being pulled toward the turn knob 302 as a result of the turn knob 302 being rotated. This movement of the cable 304 causes the pin member 142 to be withdrawn from either aperture 114, 116 in the second bracket 104, thereby "unlocking" the locking mechanism and making it possible to reposition the treadmill frame 306. When the user releases the turn knob 302, the spring 146 forces the pin 142 from the pin housing 148A, 148B, which in turn causes the cable 304 to pull on the turn knob 302, causing the turn knob 302 to rotate in a direction opposite the original turning direction. It is to be understood that the use of the actuator mechanism 300 with the locking assembly 100 of FIG. 3 is merely exemplary and that the actuator assembly 300 can be used with any equivalent or similar embodiment of the locking assembly and further that the locking assembly 100 can be used with any known actuator assembly capable of moving the pin member 142 between extended and non-extended positions.

Continuing to use FIG. 3 as an exemplary embodiment, in the operating configuration (i.e. the treadmill frame 306 positioned rearwardly from the pivot axis and substantially horizontal to the floor or ground), the pin 142 extends out of the pin housing 148A, 148B and into the aperture 116 of the second bracket 104. As shown in FIG. 3, the aperture 116 is elongated, which allows a user to lift the treadmill frame 206 some distance without having to first extract the pin 142 from the aperture 116. In other embodiments, the aperture 116 is not elongated, and as such, does not allow the treadmill frame 306 to be moved without first extracting the pin 142 from the aperture 116. Still other embodiments of the present invention utilize only one aperture in the second bracket to allow a user to selectively lock the treadmill in only the operating configuration or the storage configuration.

To place the treadmill in the storage configuration (i.e. the treadmill frame 306 extends upwardly from the pivotal connection), the user first reaches under the treadmill frame 306 and twists the turn knob 302 until the pin member 142 is extracted from the aperture 116. In embodiments having an elongated aperture 116 similar to the aperture shown in FIG. 3, the user may lift the rear end portion of the treadmill frame 306 slightly before turning the turn knob 302, which provides the user better initial access to the turn knob 302. Once the pin 142 is extracted from the aperture 116, the first bracket 102 is free to move relative to the second bracket 104. Hence, the treadmill frame 306 is free to pivot relative to the base frame (not shown). Once the user moves the treadmill frame 306 upward a sufficient distance such that the pin 142 is no longer in alignment with the aperture 116 in the second bracket 104, the user may release the turn knob 302, which allows the spring 146 to force the pin 142 against side 132 of the second bracket 104. Once the treadmill frame 306 is lifted to the upright storage position such that the aperture 114 is aligned with the pin 142, the spring 146 forces the pin 142 into the aperture 114, which in turn holds the first bracket 102 in a fixed position relative to the second bracket 104, locking the treadmill frame 306 in the storage position. To return the treadmill frame 306 to the operating configuration, the user turns the turn knob 302 to extract the pin 142 from the aperture 114 and lowers the treadmill frame 306 until the spring 146 forces the pin 142 into the aperture 116.

Figure 12:
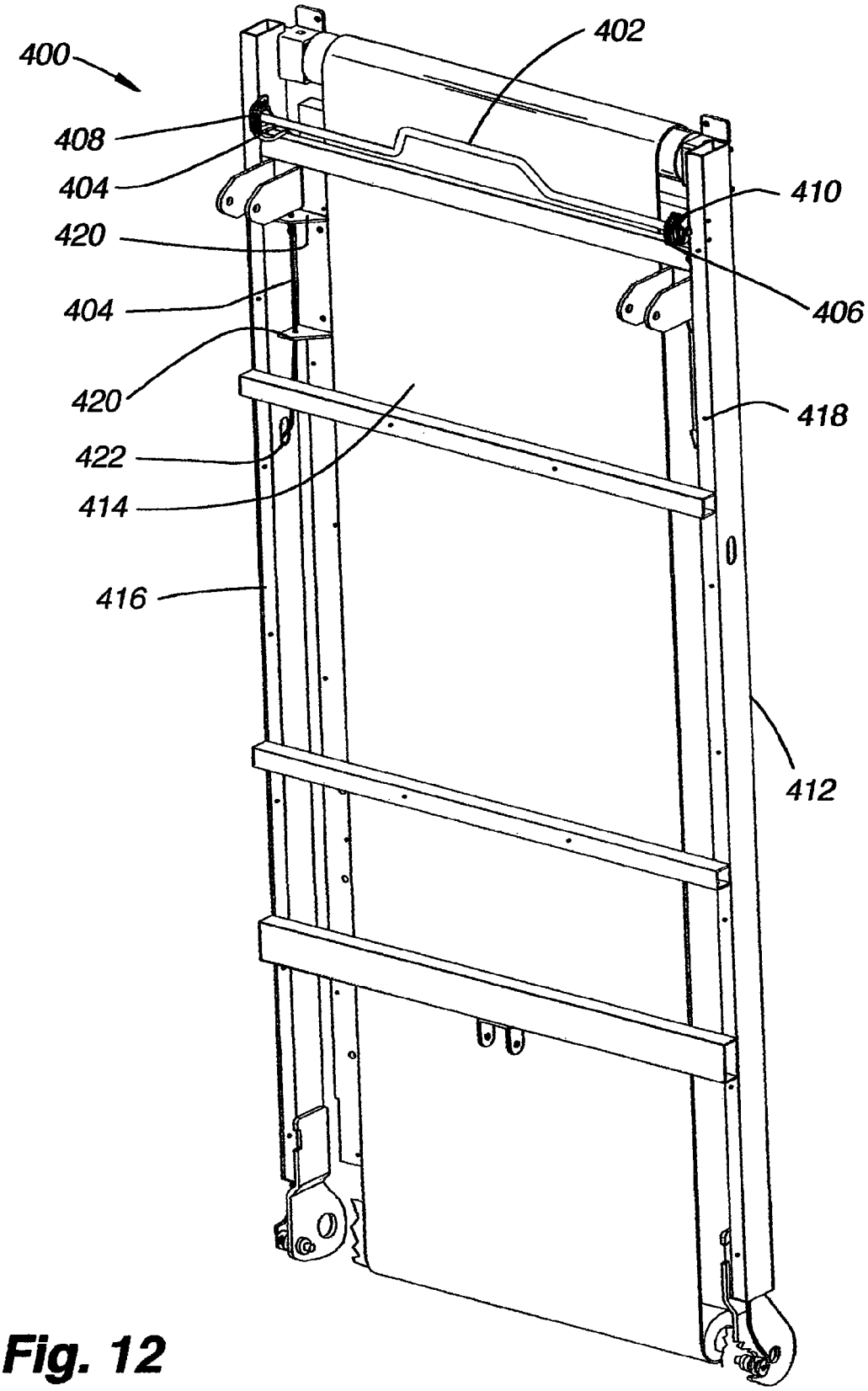
FIG. 12 is a isometric view of the underside of a treadmill base with an actuator mechanism, according to one embodiment of the present invention.
Figure 13:
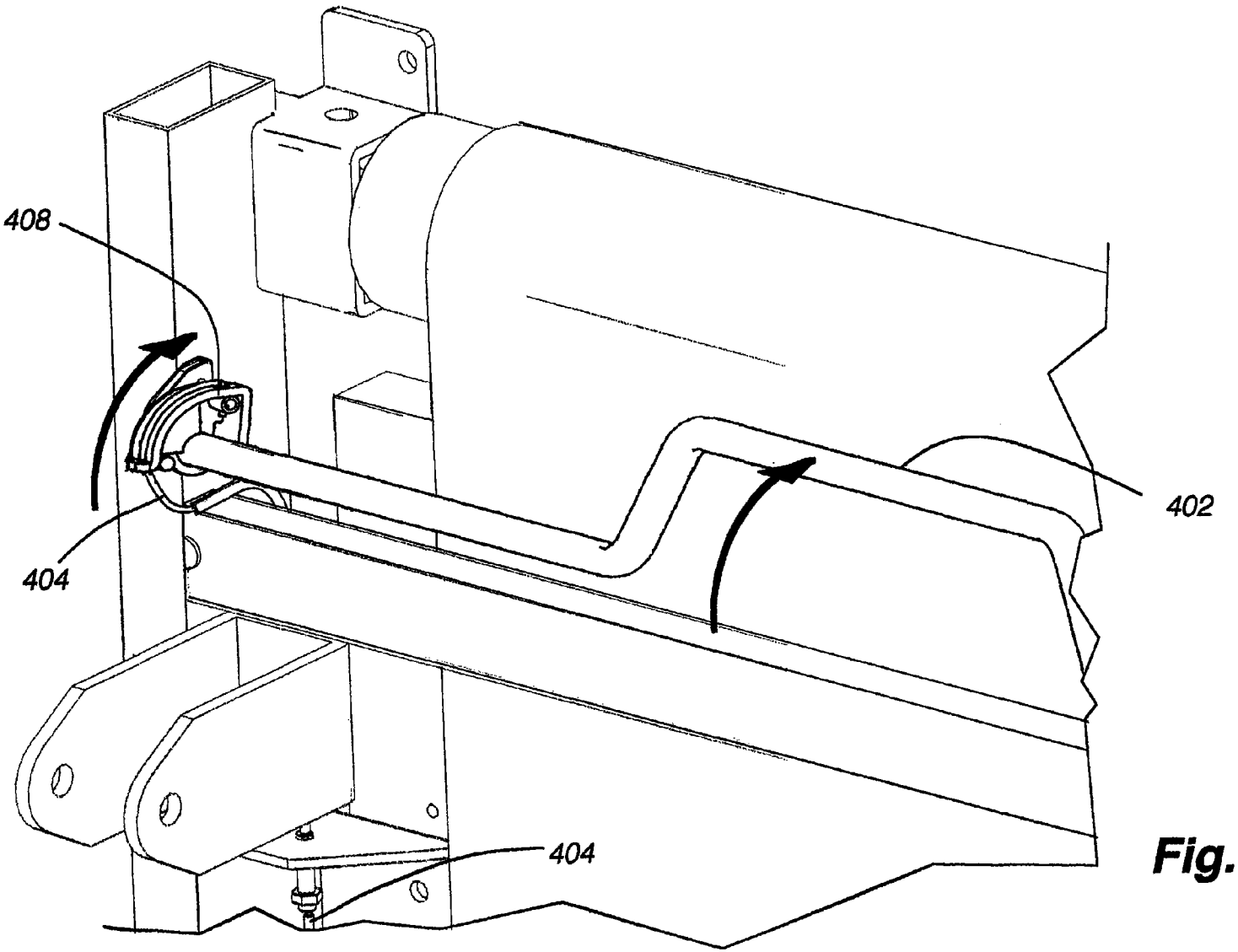
FIG. 13 is an isometric view of an actuator mechanism, according to one embodiment of the present invention.
Figure 14:
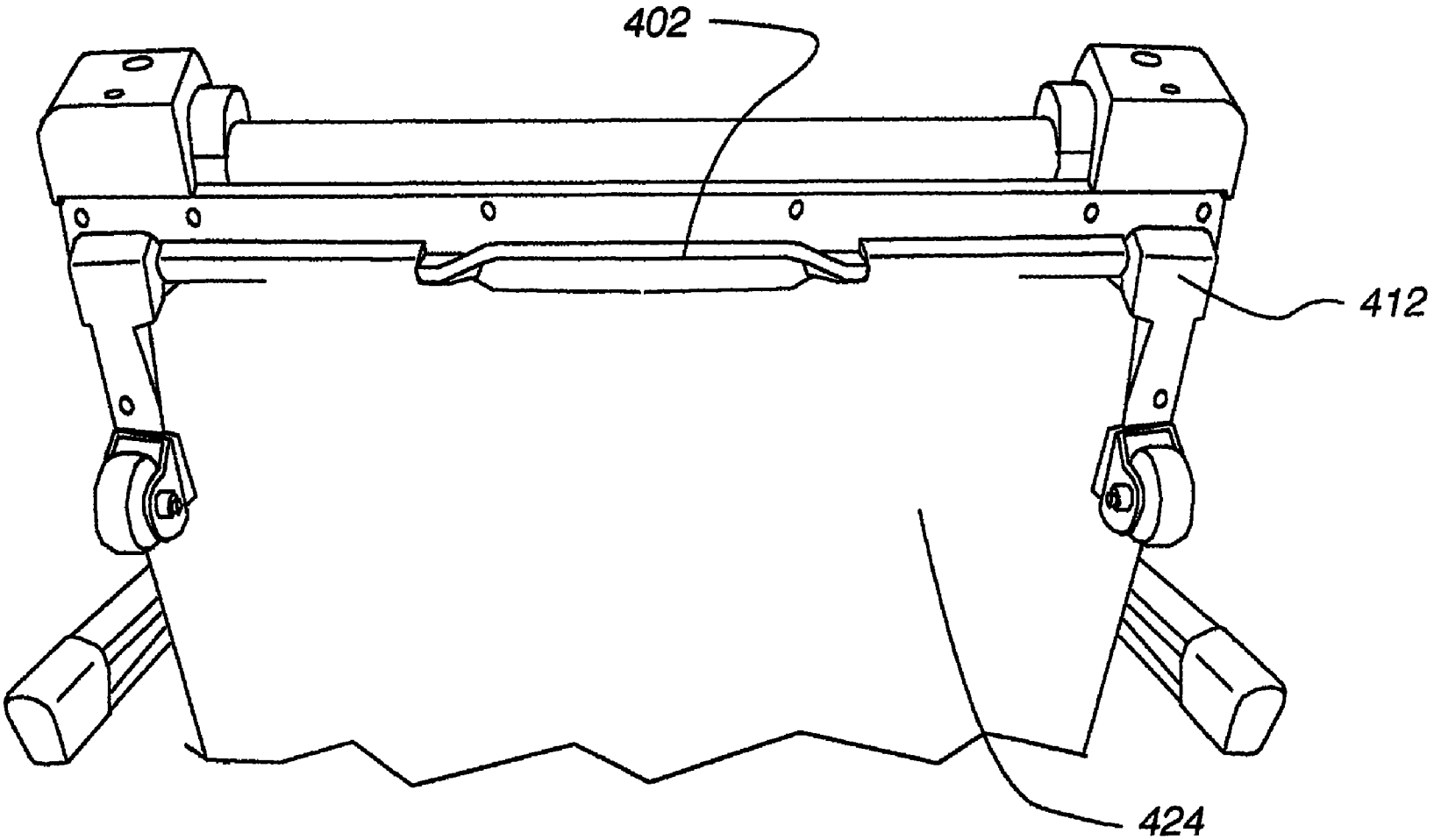
FIG. 14 is a bottom view of an actuator mechanism on the underside of a treadmill base, according to one embodiment of the present invention.

FIGS. 12, 13, and 14 depict an alternative actuator mechanism 400, according to another embodiment of the present invention. The actuator mechanism 400 is located on the underside 414 of a treadmill frame 412 and includes a locking handle 402 and two cables 404, 406 coupled to the locking handle 402, with cable 404 coupled at the left end of the locking handle 402 and cable 406 coupled at the right end. The locking handle 402, according to one embodiment, has a cam member 408 at the left end of the handle 402 and cam member 410 at the right end. The cable 404 is coupled at one end to the cam member 408 and is positioned such that the cable 404 is disposed along or inside the left rail 416 of the treadmill frame 412 as shown in FIG. 12. According to one embodiment, the cable is disposed within guide members 420 and further disposed within the left rail 416 at the cable aperture 422. Further, cable 406 is coupled at one end to the cam member 410 and is disposed along or inside the right rail 418 in a configuration similar to cable 404 (not shown).

According to one embodiment, the other end of each cable 404, 406 is attached to separate locking mechanisms. In one aspect of the invention, cable 404 is attached to a left locking mechanism that, according to one embodiment, can be a locking mechanism similar to the mechanism depicted in FIG. 7, while cable 406 is attached to a right locking mechanism that, according to one embodiment, can be a locking mechanism similar to the mechanism depicted in FIG. 3. Alternatively, each of the cables 404, 406 can be attached to any known locking mechanism that can be unlocked by pulling on each of the cables 404, 406.

FIG. 14 depicts a locking handle 402 on the underside of the treadmill frame 412. In this embodiment, the actuator mechanism is substantially covered by a shrouding 424 on the underside of the frame 412, with only the handle 402 itself exposed in order for the user to be able to actuate the handle 402.

In use, a user can use the actuator mechanism 400 to selectively "unlock" the locking mechanism and reposition the treadmill frame 412 in relation to a base frame. Thus, when a user pulls the locking handle 402 upward in the direction of the arrow in FIG. 13 such that each cam 408, 410 pivots about a common horizontal axis, each cam 408, 410 applies pressure to the respective cables 404, 406, causing the cables to be pulled in the direction of the cams 408, 410. According to one embodiment, the cables 404, 406 are attached to the exemplary locking mechanisms of FIGS. 3 and 7. In this embodiment, pulling the cables 404, 406 in the direction of the cams 408, 410 causes the cable 404 to pull the pin member 342 away from the second bracket 304 and further causes cable 406 to pull the pin member 142 away from the second bracket 104. Thus, pin member 342 is withdrawn from either aperture 314 or 316, unlocking the left locking mechanism, and pin member 142 is withdrawn from either aperture 114 or 116, unlocking the right locking mechanism, and thereby allowing the user to reposition the treadmill frame 412. In an alternative embodiment, the locking handle is connected to one cable and only unlocks one locking mechanism. In one aspect, the locking handle is attached to a cable on the left end of the handle and the cable is attached to a left locking mechanism. Alternatively, the locking handle is attached to a cable on the right end of the handle and the cable is attached to a right locking mechanism.

As described above in relation to the first embodiment of the locking mechanism, actuating the locking handle 402 and thereby unlocking the locking mechanism allows a user to pivot the treadmill frame 412 relative to the base frame (not shown) about the pivot axis (not shown) to configure the treadmill in either the storage configuration or operating configuration.

It is to be appreciated that various forms of actuator mechanisms can be used with the locking mechanism to actuate the engagement member and should not be construed to be limited to the actuator mechanisms described and depicted herein. For example, instead of having the turn knob or locking handle described above, other forms of the locking mechanism can include a knob or handle located at a distal end portion of the treadmill frame that is adapted to be pushed or pulled in a linear direction relative to the treadmill frame, as opposed to pivoting or rotating. Such an actuator mechanism can also be operably coupled with the engagement member via a cable or a rigid member, such as a rod or pole.

Figure 15:
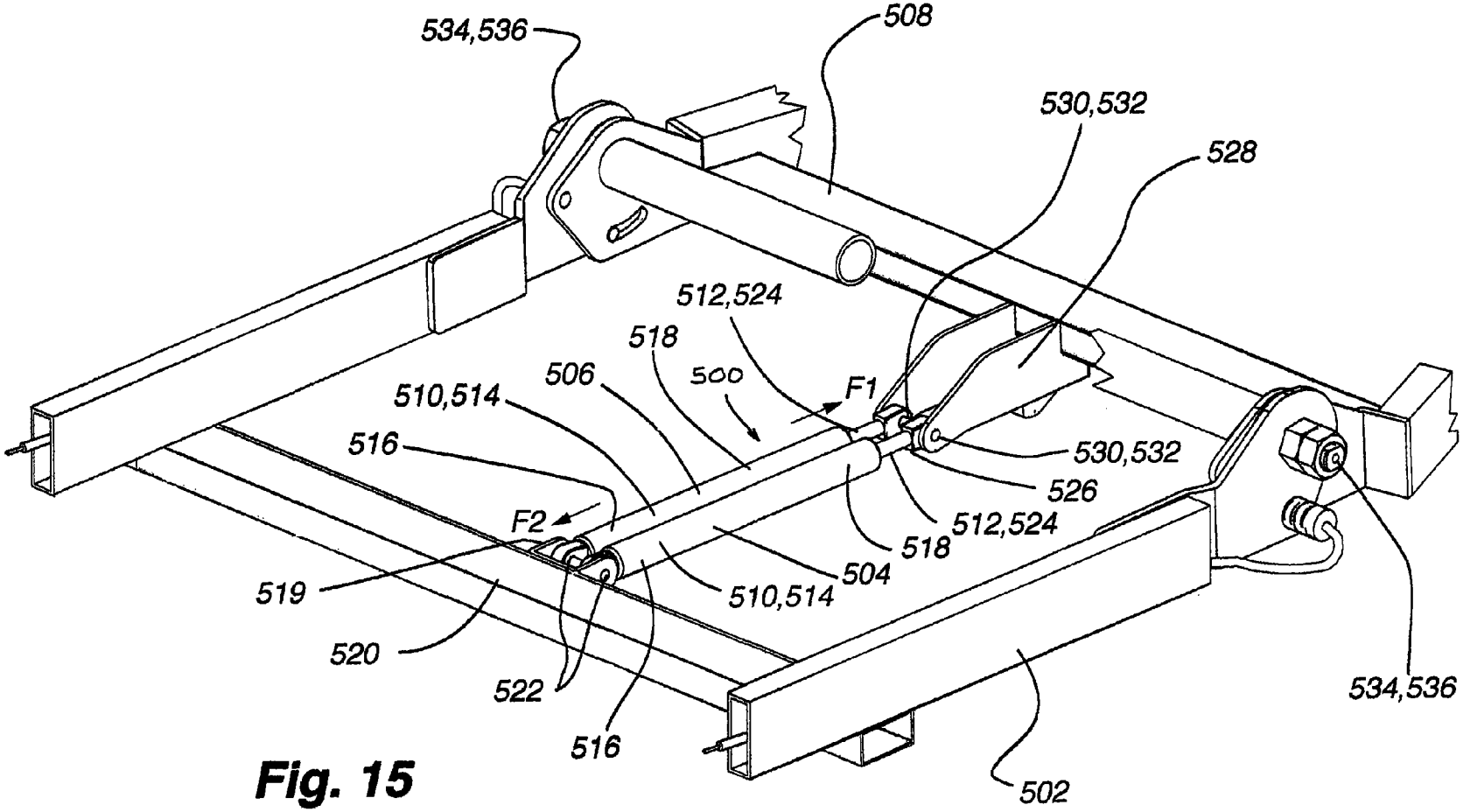
FIG. 15 is a right side isometric view of a portion of a treadmill base with a lift assistance mechanism, according to one embodiment of the present invention.
Figure 16:
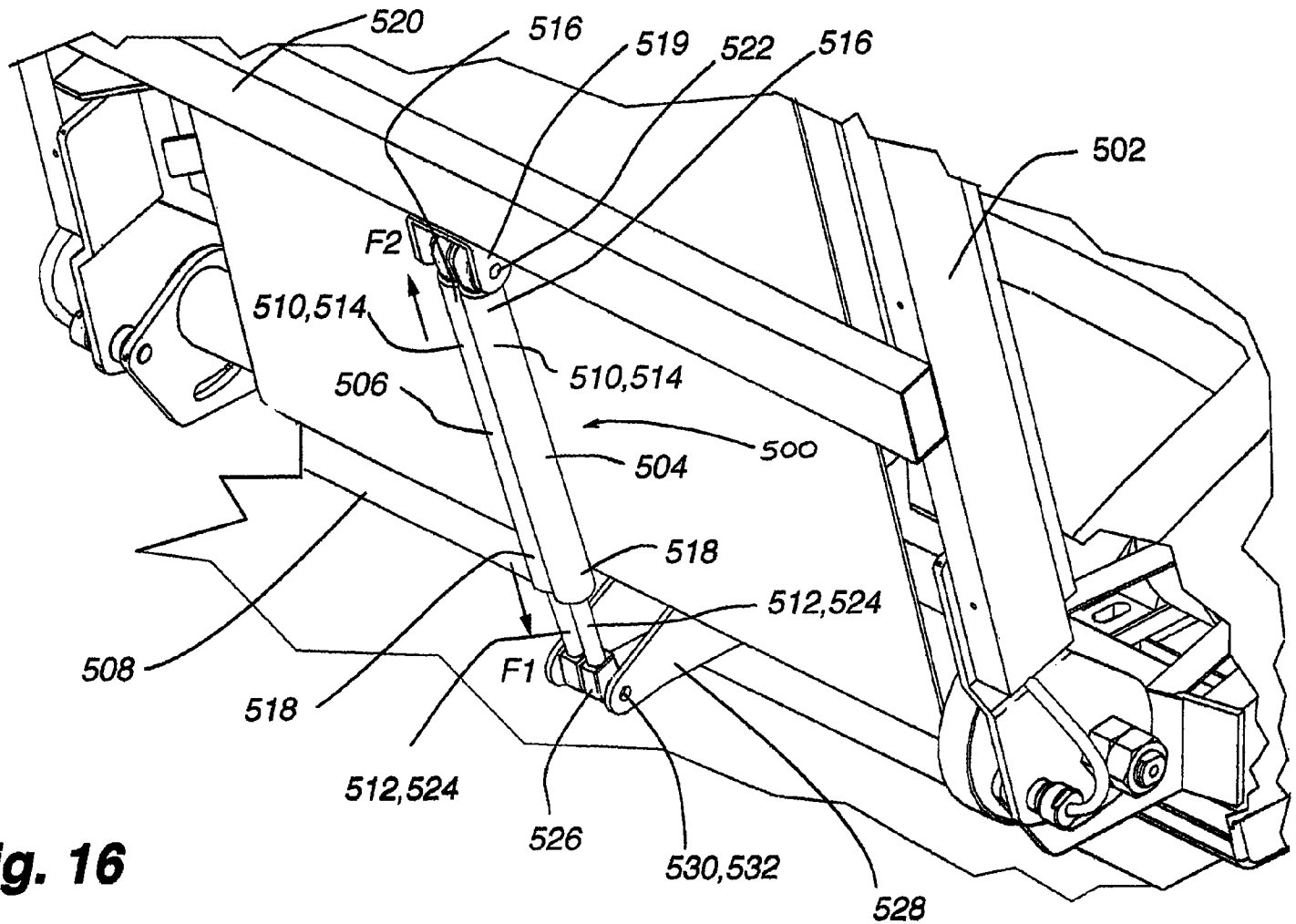
FIG. 16 is a right side isometric view of a portion of a treadmill base with a lift assistance mechanism, according to one embodiment of the present invention.

FIGS. 15 and 16 show detailed views of a treadmill including a lift assistance mechanism 500 configured to apply forces on a treadmill frame 502 to resist pivotal movement of the treadmill frame in the downward direction. As such, the lift assistance mechanism helps to slow the rate at which the treadmill frame would otherwise move when pivoting downward from the storage position to the operating position. In this manner, the lift assistance mechanism helps to prevent the treadmill frame from pivoting downward at a relatively high rate of speed, such as when free falling from the upright storage configuration (see FIG. 16) to the downward operating configuration (see FIG. 15). In addition, the lift assistance mechanism 500 allows a user to more easily lift and pivot the treadmill frame 502 from the operating configuration shown in FIG. 15 to the storage configuration shown in FIG. 16.

In the embodiment shown in FIGS. 15 and 16, the lift assistance mechanism 500 includes two lift cylinders 504, 506. As discussed in more detail below, the lift cylinders contain pressurized air that acts to extend the overall length lift cylinders, which in turn, applies forces on the treadmill frame 502 that resist downward pivotal motion of the treadmill frame. As shown in FIGS. 15 and 16, each lift cylinder 504, 506 is pivotally connected with a base frame 508 and the treadmill frame 502. More particularly, each lift cylinder 504, 506 includes a cylinder portion 510 operably connected with a piston portion 512. The cylinder portion includes a hollow cylinder body 514 having a circular cross section and having a closed first end portion 516 and a second end portion 518. The closed first end portion 516 of the cylinder body 514 is pivotally connected with a first bracket 519 connected with a cross member 520 on the treadmill frame 502 at a first end pivotal connection 522. The piston portion includes a piston shaft 524 connected with a piston head (not shown) inside the cylinder body 514. The piston shaft 524 extends from the piston head (not shown), through the second end portion 518 of the cylinder body 514, to a second end portion 526 pivotally connected with a second bracket 528 connected with the base frame 508 at a second end pivotal connection 530. The second pivotal connection 530 defines a lift cylinder pivot axis 532 about which the lift cylinders 504, 506 pivot when the treadmill frame 502 pivots relative to the base frame 508. As discussed in more detail below, pressurized air inside the cylinder body between closed first end portion of the cylinder body and the piston head acts to force piston head toward the second end portion of the cylinder body, which in turn, causes the lift cylinders to press against the treadmill frame and the base frame in the directions F1 and F2 shown in FIGS. 15 and 16.

As discussed above with reference to various treadmill embodiments and as shown in FIGS. 15 and 16, the treadmill frame 502 is pivotally connected with the base frame 508 at a pivotal connection 534, defining a first pivot axis 536. The first pivot axis 536 is positioned forward and upward relative to the lift cylinder pivot axis 532. The relative positions of the first pivot axis 536 and the lift cylinder pivot axis 532 causes the piston shafts 524 of the lift cylinders 504, 506 to extend from and compress into the cylinder bodies 514 as the treadmill frame 502 pivots up and down relative to the base frame 508. More particularly, the lift cylinders 504, 506 define a relatively extended length when the treadmill frame is in the upright storage configuration shown in FIG. 16. Conversely, the lift cylinders define a relatively compressed length when the treadmill frame is in the downward operating configuration shown in FIG. 15. As previously mentioned, pressurized air inside the lift cylinders causes the lift cylinders to press against the treadmill frame 502 and the base frame 508 in the directions F1 and F2 shown in FIGS. 15 and 16. As the treadmill frame 502 pivots from the storage configuration to the operating configuration, movement of the piston shafts 524 of the lift cylinders into the cylinder bodies 514 causes the air pressure inside the lift cylinders to increase. As such, the forces exerted by the lift cylinders on the base frame and the treadmill frame increases as the treadmill frame pivots downward from the storage configuration to the operating configuration.

As previously mentioned, forces exerted by the lift cylinders 504, 506 on the base frame 508 and the treadmill frame 502 resist the moment forces caused by the weight of the treadmill frame and deck as the treadmill frame pivots between the operating and storage configurations. As such, forces exerted by the lift cylinders on the treadmill frame act to slow the rate at which the treadmill frame would otherwise pivot from the storage configuration to the operating configuration, such as when free falling. In addition, the forces exerted by the lift cylinders on the treadmill frame lessen the forces required to lift and pivot the treadmill frame from the operating configuration to the storage configuration.

It is to be appreciated that various embodiments lift assistance mechanisms can utilize various sizes, types, and arrangements of lift cylinders and are not limited to the arrangement depicted and described herein. For example, some lift assistance mechanisms include lift cylinders with air pressurized to 600 psig with an extended or neutral uncompressed length of 425 mm. In another scenario, depending on the length and weight of the treadmill frame as well as the force characteristics of the lift cylinder, the lift mechanism may include a single lift cylinder as opposed to two lift cylinders. In such an arrangement, a spacer can be installed to consume the vacant space in the bracket where a second cylinder would otherwise be located. In one particular example, a treadmill having a deck length of 60 inches may utilize two lift cylinders whereas a treadmill having a deck length of 54 inches may utilize only one lift cylinder. It should also be appreciated that more than one lift cylinder can be used. Further, it should be appreciated that lift assistance mechanism is not limited to having air pressurized lift cylinders and can include any known mechanism capable of applying an upward force on the treadmill frame, such as a spring or some type of hydraulic system.

It will be appreciated from the above noted description of various arrangements and embodiments of the present invention that a locking mechanism for use with a foldable exercise treadmill has been described which allows a user to selectively configure a treadmill in an operating configuration and/or a storage configuration. The locking mechanism can be formed in various ways and operated in various manners. It will be appreciated that the features described in connection with each arrangement and embodiment of the invention are interchangeable to some degree so that many variations beyond those specifically described are possible.

Although various representative embodiments of this invention have been described above with a certain degree of particularity, those skilled in the art could make numerous alterations to the disclosed embodiments without departing from the spirit or scope of the inventive subject matter set forth in the specification and claims. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A treadmill comprising:

a base frame;

a treadmill frame including a first end portion and a second end portion distal the first end portion;

the treadmill frame moveably connected to the base frame proximate the first end portion of the treadmill frame, the treadmill frame configurable between an operating configuration and a storage configuration;

a belt operatively associated with the treadmill frame;

a locking mechanism comprising:

an engagement member positioned proximate the first end portion of the treadmill frame;

an actuator operatively associated with the engagement member, the actuator positioned distal from the engagement member and proximate the second end portion of the treadmill frame; and the actuator selectively actuated to operatively engage and disengage the engagement member with the base frame;

operative engagement of the engagement member with the base frame prevents the treadmill frame from being moved relative to the base frame between the operating configuration and the storage configuration; and operative disengagement of the engagement member from the base frame allows the treadmill frame to be moved relative to the base frame between the operating configuration and the storage configuration.

2. The treadmill of claim 1, wherein the engagement member and the actuator are supported by the treadmill frame.

3. The treadmill of claim 2, wherein the base frame includes at least one aperture, and at least a portion of the engagement member is received with the at least one aperture to engage the engagement member with the base frame.

4. The treadmill of claim 2, wherein the base frame includes a first aperture and a second aperture, at least a portion of the engagement member is received with the first aperture to engage the engagement member with the base frame when the treadmill is positioned in the operating configuration, and at least a portion of the engagement member is received in the second aperture to engage the engagement member with the base frame when the treadmill is positioned in the storage configuration.

5. The treadmill of claim 4, wherein the first aperture comprises a slot.

6. The treadmill of claim 4, wherein the base frame includes a bracket, and the bracket defines the first aperture and the second aperture.

7. The treadmill of claim 1, wherein the engagement member comprises a pin.

8. The treadmill of claim 1, wherein the locking mechanism further comprises a bias member that biases the engagement member into operative engagement with the base frame.

9. The treadmill of claim 1, wherein the actuator comprises a handle, and selective rotation of the handle operatively disengages the engagement member from the base frame.

10. The treadmill of claim 1, further comprising a lift assistance mechanism operably coupled to the treadmill frame and the base frame.

11. The treadmill of claim 10, wherein the lift assistance mechanism comprises at least one lift cylinder.

12. The treadmill of claim 11, wherein the at least one lift cylinder contains pressurized air.

13. The treadmill of claim 11, wherein the at least one lift cylinder defines an extended length when the treadmill frame is in a storage position, and the at least one lift cylinder defines a compressed length when the treadmill frame is in a operating position.

14. The treadmill of claim 1, wherein the treadmill frame is moveably connected to the base frame by pivotally connecting the treadmill frame to the base frame.

15. The treadmill of claim 14, wherein the treadmill frame is configured between the operating position and the storage position by pivoting the treadmill frame relative to the base frame.

16. A treadmill comprising:

a base frame;

a treadmill frame moveably connected to the base frame, the treadmill frame configurable between an operating configuration and a storage configuration;

a belt operatively associated with the treadmill frame;

a locking mechanism comprising:

an engagement member;

an actuator operatively associated with the engagement member via a cable, the actuator positioned distal from the engagement member; and the actuator selectively actuated to operatively engage and disengage the engagement member with the base frame;

operative engagement of the engagement member with the base frame prevents the treadmill frame from being moved relative to the base frame between the operating configuration and the storage configuration; and operative disengagement of the engagement member from the base frame allows the treadmill frame to be moved relative to the base frame between the operating configuration and the storage configuration.

* * * * *